US012139823B2

(12) United States Patent
Hu et al.

(10) Patent No.: US 12,139,823 B2
(45) Date of Patent: Nov. 12, 2024

(54) CONTINUOUS AUTOMATIC TWISTING AND WINDING DEVICE AND METHOD FOR POLYMER FIBER ARTIFICIAL MUSCLES

(71) Applicant: JIANGSU UNIVERSITY, Zhenjiang (CN)

(72) Inventors: Xinghao Hu, Zhenjiang (CN); Xianfu Bao, Zhenjiang (CN); Yingming Wang, Zhenjiang (CN); Jianning Ding, Zhenjiang (CN); Guanggui Cheng, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 17/790,766

(22) PCT Filed: Feb. 24, 2022

(86) PCT No.: PCT/CN2022/077554
§ 371 (c)(1),
(2) Date: Jul. 5, 2022

(87) PCT Pub. No.: WO2022/267501
PCT Pub. Date: Dec. 29, 2022

(65) Prior Publication Data

US 2024/0167199 A1 May 23, 2024

(30) Foreign Application Priority Data

Jun. 25, 2021 (CN) ..... 202110712484.2
Feb. 14, 2022 (CN) ..... 202210132722.7

(51) Int. Cl.
*D01H 1/241* (2006.01)
*D01H 7/02* (2006.01)
*D01H 13/10* (2006.01)

(52) U.S. Cl.
CPC ..... *D01H 1/241* (2013.01); *D01H 7/02* (2013.01); *D01H 13/104* (2013.01)

(58) Field of Classification Search
CPC ..... D01H 1/241; D01H 1/24; D01H 1/36; D01H 1/242; D01H 7/02; D01H 13/104;
(Continued)

(56) References Cited

U.S. PATENT DOCUMENTS 2,717,528 A * 9/1955 Swackhamer ..... D04C 3/48 87/37
2,788,632 A * 4/1957 Dewhirst ..... D01H 13/10 57/68
(Continued)

FOREIGN PATENT DOCUMENTS

CH 334581 A 12/1958
CN 101918628 A 12/2010
(Continued)

OTHER PUBLICATIONS

Carter S. Haines, et al., Artificial Muscles from Fishing Line and Sewing Thread, Science, 2014, pp. 868-872, vol. 343, No. 6173.

*Primary Examiner* — Khoa D Huynh
*Assistant Examiner* — Uyen T Nguyen
(74) *Attorney, Agent, or Firm* — Bayramoglu Law Offices LLC

(57) ABSTRACT

A continuous automatic twisting, and winding device and method for the polymer fiber artificial muscle are provided. The device includes a wire feeding mechanism, polymer fibers, a twisting mechanism, a winding mechanism, a translation mechanism, and a base plate. The center axis of the rolling bearing I in the wire feeding mechanism is horizontally aligned with the center axis of the spline shaft in the winding mechanism; the polymer fibers are generally nylon fibers, polyester fibers, etc.; the twisting mechanism, winding mechanism and the translation mechanism are
(Continued)

mounted on the base plate; the twisting mechanism articulation seat in the twisting mechanism is fixed on the front support seat in the winding mechanism; the mounted bearing in the translation mechanism is connected to the spline shaft in the winding mechanism by interference fit. The guide rod in the translation mechanism is mounted on the rear support seat in the winding mechanism.

4 Claims, 5 Drawing Sheets

(58) Field of Classification Search
CPC ..... D01H 13/10; B65H 54/28; B65H 54/44; B65H 54/553; B65H 54/70; B65H 59/18
See application file for complete search history.

(56) References Cited

U.S. PATENT DOCUMENTS 2,830,431 A * 4/1958 Klein ..... D02G 3/285
57/58.7
3,811,628 A * 5/1974 Glazener ..... D01H 1/36
242/478.3
4,682,637 A * 7/1987 Strohm, Jr. ..... D04C 3/04
140/9
4,803,909 A * 2/1989 Smith ..... D04C 3/22
87/8
4,921,567 A * 5/1990 Criswell, Jr. ..... B65H 54/28
156/425
5,383,387 A * 1/1995 Chesterfield ..... D04C 3/48
87/22
2003/0141101 A1* 7/2003 Mima ..... H01B 7/306
174/128.1
2004/0093846 A1* 5/2004 Baitelli ..... D01H 1/22
57/264
2007/0017197 A1* 1/2007 Olde Weghuis ..... D01H 1/103
57/62
2017/0101287 A1* 4/2017 Griesshammer ..... B65H 63/02

FOREIGN PATENT DOCUMENTS

CN 103757766 A 4/2014
CN 108839329 A 11/2018
CN 112266494 A 1/2021
CN 112875420 A 6/2021
CN 113463232 A 10/2021
GB 1441425 A 6/1976
JP 2021055205 A 4/2021

* cited by examiner

CONTINUOUS AUTOMATIC TWISTING AND WINDING DEVICE AND METHOD FOR POLYMER FIBER ARTIFICIAL MUSCLES

CROSS REFERENCE TO THE RELATED APPLICATIONS

This application is the national phase entry of International Application No. PCT/CN2022/077554, filed on Feb. 24, 2022, which is based upon and claims priority to Chinese Patent Applications No. 2021107124842, filed on Jun. 25, 2021, and No. 202210132722.7, filed on Feb. 14, 2022, the entire contents of which are incorporated herein by reference.

TECHNICAL FIELD

The present invention relates to a polymer fiber artificial muscle, and specifically refers to a continuous automatic twisting and winding device and method for the polymer fiber artificial muscle.

BACKGROUND

The polymer fiber artificial muscle was first proposed by Haines et al. in the article "Artificial Muscles from Fishing Line and Sewing Thread" [J]. (Science, 2014, 343(6173): 868-872). Compared with other helical fiber artificial muscles, polymer fiber artificial muscles have the advantages of large stress, large stroke, high energy density, strong stability, and inexpensive. At present, many researchers are working on their practical applications.

The polymer fiber artificial muscle can be made by twisting a polymer fiber. As mentioned in the Chinese invention patent with the application number of CN202010932284.3, one end of the fiber is fixed on the motor shaft, and the other end is hung with a heavy object. An electric motor is used for twisting the fiber until the fiber completely form a helical structure, so that the helical fiber artificial muscle is successfully fabricated.

The Chinese patent invention with the application number CN201810635660.5 proposes a quantitative preparation and testing device and method for polyamide fiber artificial muscles. The device uses a stepper motor to achieve quantitative and controllable torsion of polyamide fibers; They use an electric heating tube to uniformly and quantitatively heats polyamide fiber artificial muscles, and use a thermal infrared camera for real-time monitoring, and feedback control; uses force sensors to measure the real-time generated force of polyamide fiber artificial muscles. The device can realize the quantitative preparation of polyamide fiber artificial muscle and the correlation measurements of generated force and stroke.

However, the fiber artificial muscle preparation method mentioned in the above patent can only fabricate twist fibers with limited length, and cannot realize continuous twisting of fibers. Therefore, the invention of a device that can continuously and automatically twist and wind polymer fibers is of great significance for the practical application of polymer fiber artificial muscles.

SUMMARY

The present invention aims to solve the limitation that the above-mentioned traditional fiber artificial muscle preparation method has low efficiency and can only prepare artificial muscles with limited length. The present invention provides a device that can continuously and automatically twist and wind polymer fibers and can precisely control the twisting load of fiber artificial muscles. The device greatly improves the preparation efficiency of artificial muscles, realizes the automatic production of polymer fiber artificial muscles, and is of great significance to the application of polymer fiber artificial muscles.

In order to achieve the above purpose, the present invention provides a continuous automatic twisting and winding device for polymer fiber artificial muscles. The device includes (1) a wire feeding mechanism, a polymer fiber; (2) a twisting mechanism; (3) a winding mechanism; (4) a translation mechanism and a base plate. The central axis of a rolling bearing I in the wire feeding mechanism is horizontally aligned with a central axis of a spline shaft in the winding mechanism; the polymer fibers are generally nylon fiber filaments, polyester fiber filaments, etc.; the twisting mechanism, the winding mechanism and the translation mechanism are mounted on the base plate; a twisting mechanism articulation seat in the twisting mechanism is fixed on a front support seat in the winding mechanism; a mounted bearing in the translation mechanism is connected with the spline shaft in the winding mechanism by an interference fit. A guide rod in the translation mechanism is mounted on a rear support seat in the winding mechanism and is fixed with a nut.

The continuous automatic twisting and winding device for polymer fiber artificial muscles including the following steps:

As a preferred embodiment of the present invention, in step (1): the wire feeding mechanism includes a torque motor, a torque motor mounting support, a spool I, a bottom plate of the wire feeding mechanism, a wire feeding pulley I, a wire feeding pulley II, a rolling bearing I and a wire feeding platform; the torque motor is fixed on the bottom plate of the wire feeding, mechanism through the torque motor mounting support; the spool I is installed on an output shaft of the torque motor; the wire feeding pulley I and the wire feeding pulley II are installed on the wire feeding platform, and the two wire feeding pulleys can prevent a torque of the fiber from being transmitted to the spool I; the rolling bearing I is installed in a hole at a front end of the wire feeding platform, the fiber passing through the rolling bearing can effectively reduce an abrasion of a fiber filament; the wire feeding platform is fixed on the bottom plate of the wire feeding mechanism, and a tension on the fiber filament during a working process can be controlled by adjusting an output torque of the torque motor.

As a preferred embodiment of the present invention, in step (2): the twisting mechanism includes a synchronous belt wheel I, a synchronous belt I, a winding rod, a synchronous belt wheel II, a synchronous belt wheel support, rolling bearing II, a twisting mechanism articulation seat a stepper motor mounting support I and a stepper motor I; the synchronous belt wheel I is installed on an output shaft of the stepper motor I, and is limited by set screws to prevent a relative sliding; the stepper motor I is installed on the stepper motor mounting support I; one end of the winding rod is tapped with an external thread to be threadedly connected to the synchronous bell wheel II; the synchronous belt wheel II is installed on one end of the synchronous belt wheel support and set screws are used to prevent a relative rotation; an inner side of the synchronous belt wheel support is installed with the rolling bearing II in the interference fit; an inner hole of the rolling bearing II is the interference fit with a shaft of the twisting mechanism articulation seat; the twisting mechanism articulation seat is installed on the front support seat of the winding mechanism; the synchronous belt is installed on the two synchronous belt wheels; in this way; the stepper motor I rotates the winding rod by means of a belt transmission, and the winding rod rotates the polymer fiber to complete twisting.

As a preferred embodiment of the present invention, in step (3): the winding mechanism includes a front support seat, a rolling bearing III, a rear support seat, a spool II, a spline shaft, a spline shaft sleeve, a rolling bearing IV, a synchronous belt wheel III, a gear ring, a synchronous belt II, a synchronous belt wheel IV, a stepper motor mounting support II, a stepper motor II; wherein the spool II is installed on one end of the spline shaft; the spline shaft sleeve has an interference fit with the inner hole of the rolling bearing IV; the rolling bearing IV is installed in the front support seat and has an interference fit with the inner hole of the front support seat; the spline shaft is installed in the spline shaft sleeve, and can slide relative to the axial direction; the inner hole of the rear support seat is also installed with a rolling bearing, the rolling, bearing is installed with a spline shaft sleeve, and the spline shaft passes through the spline shaft sleeve and it is a clearance fit, and the spline shaft can slide axially relative to the spline shaft sleeve; the spline shaft is sleeved with two of the gear rings and is located between the front support seat and rear support seats; the inner hole of the synchronous belt wheel III is also installed with a spline shaft sleeve and is installed on the splined shaft, which is located between the two gear rings; the synchronous belt wheel IV is installed on the output shaft of the stepper motor II, and is limited by set screws to prevent a relative sliding; the stepper motor II is installed on the stepper motor mounting support II; the synchronous belt II is installed on the synchronous belt wheels III and the synchronous belt wheel IV; The stepper motor II rotated the spline shaft by means of a belt transmission, so as to make the spool II rotate to complete a winding process.

As a preferred embodiment of the present invention, in step (4): the translation mechanism includes a guide rod, a mounted bearing, a translation joint seat, a lead screw nut, a trapezoidal lead screw, a coupling shaft, a stepper motor III and a stepper motor mounting support III. One end of the guide rod is installed in the translation joint seat, and the other end is screwed into a nut for limiting; the mounted bearing is installed on the left end of the translation joint seat; the lead screw nut is installed on the right end of the translation joint seat; the trapezoidal lead screw is screwed into the lead screw nut; the stepper motor III is installed on the stepper motor mounting support III; the coupling shaft is connected with the output shaft of the stepper motor III and the trapezoidal lead screw; the stepper motor III drives the translation joint seat to slide on the guide rod.

The present invention has the following beneficial effects:

1. The polymer fibers can be continuously pulled out from the spool I and twisted;
2. The tension on the polymer fiber, that is, the twisting load, can be accurately controlled by adjusting the output torque of the torque motor;
3. The rotation of the spool II in the axial direction makes it possible to rewind the twisted artificial muscle;
4. The translation mechanism can make the spool II move back and forth in the axial direction, so that the artificial muscles are evenly collected on the spool II.
5. The overall device has a simple and ingenious structure and convenient operation, and can quickly and continuously complete the preparation of polymer fiber artificial muscles.

In the figures: 100-wire feeding mechanism; 200-polymer fiber; 300-twisting mechanism; 400-winding mechanism; 500-translation mechanism; 600-base plate; 101-torque motor; 102-torque motor mounting support; 103-spool I; 104-bottom plate of wire feeding mechanism; 105-wire feeding pulley I; 106-wire feeding pulley II; 107-rolling bearing I; 108-wire feeding platform; 301-synchronous belt wheel I; 302-synchronous belt I; 303-winding rod; 304-synchronous belt wheel II; 305-synchronous belt wheel support; 306-rolling bearing II; 307-twisting mechanism articulation seat; 308-stepper motor mounting support I; 401-front support seat; 402-rolling bearing III; 403-rear support seat; 404-spool II; 405-spline shaft; 406-spline shaft sleeve; 407-rolling bearing IV; 409 gear ring; 410-synchronized belt II; 411-synchronized belt wheel IV; 412-stepper motor mounting support II; 413-stepper motor II; 501-guide rod; 502-mounted bearing; 504-lead screw nut; 505-trapezoidal lead screw; 506-coupling shaft; 507-stepper motor mounting support III; 508-stepper motor III.

DETAILED DESCRIPTION OF THE EMBODIMENTS

Figure 1:
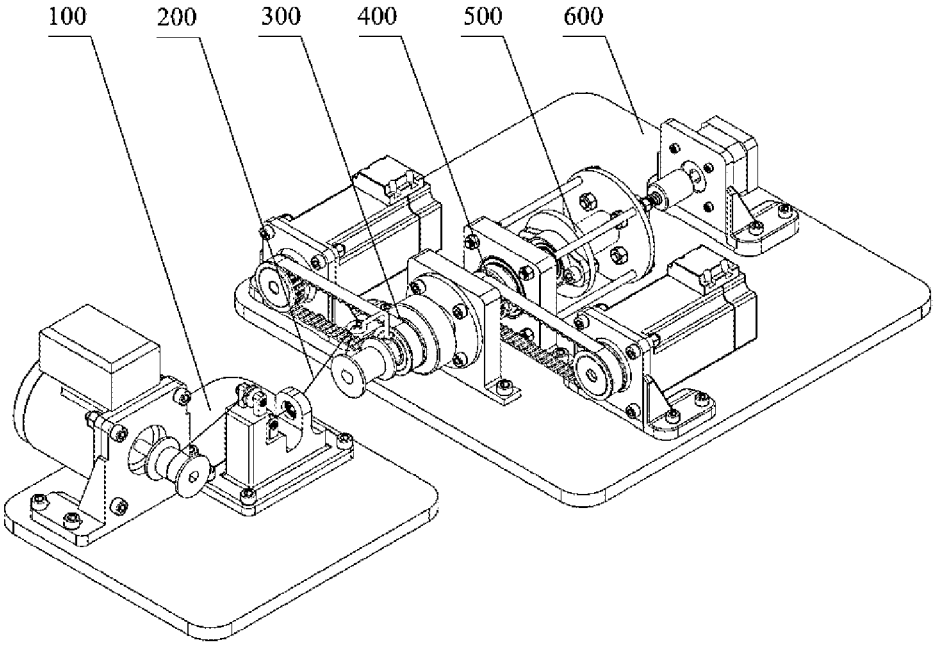
FIG. 1 is the general assembly schematic diagram of the polymer fiber artificial muscle continuous automatic twisting and winding device according to the present invention.

In order to fully understand the purpose, features and functions of the present invention, the present invention will be described in detail by means of the following specific embodiments:

FIG. 1 is the general assembly schematic diagram of the polymer fiber artificial muscle continuous automatic twisting and winding device according to the present invention. As shown in FIG. 1, the device includes a wire feeding mechanism 100, a polymer fiber 200, a twisting mechanism 300, a winding mechanism 400, a translation mechanism 500 and a base plate 600. The central axis of the rolling bearing I 107 in the wire feeding mechanism 100 is horizontally aligned with the central axis of the spline shaft 405 in the winding mechanism 400. The polymer fibers 200 are generally nylon fiber filaments, polyester fiber filaments, etc.; the twisting mechanism 300, the winding mechanism 400 and the translation mechanism 500 are installed on the base plate 600; the twisting mechanism articulation seat 307 in the twisting mechanism 300. It is fixed on the front support seat 401 in the winding mechanism 400; the mounted bearing 502 in the translation mechanism 500 is connected with the spline shaft 405 in the winding mechanism 400 by an interference fit. The guide rod 501 in the translation mechanism 500 is installed on the rear support seat 403 in the winding mechanism 400, and is fixed with a nut.

Figure 2:
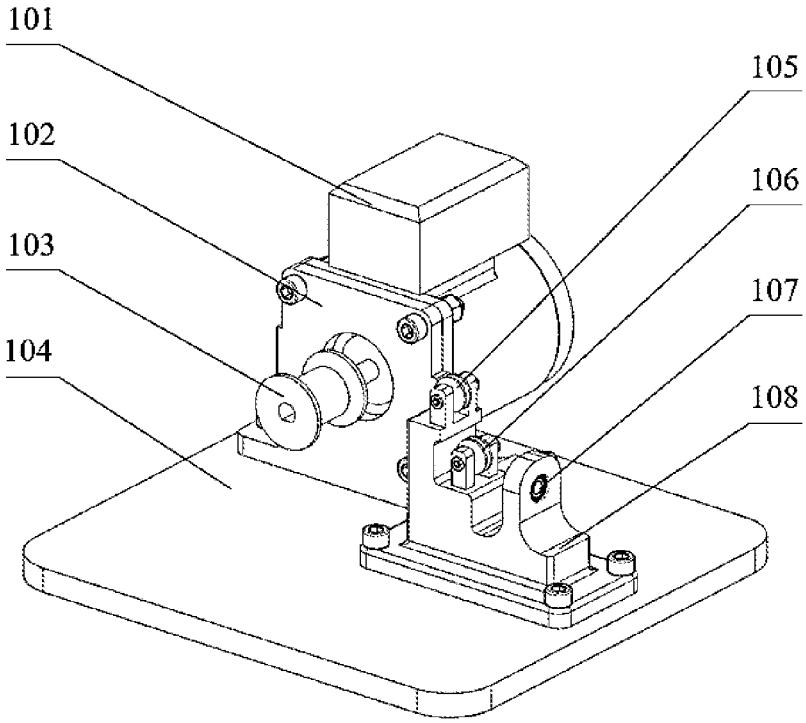
FIG. 2 is a schematic diagram of the wire feeding mechanism according to the present invention.

FIG. 2 is a schematic diagram of the wire feeding mechanism 100. As shown in FIG. 2, it includes torque motor 101, torque motor mounting support 102, spool I 103, bottom plate of wire feeding mechanism 104, wire feeding pulley I 105, wire feeding pulley II 106, rolling bearing I 107 and wire feeding platform 108. The torque motor 101 is fixed on the bottom plate 104 of the wire feeding mechanism through the torque motor mounting support 102; the spool I 103 is installed on the output shaft of the torque motor 101; the wire feeding pulley I 105 and the wire feeding pulley II 106 are installed on the feeder. On the wire feeding platform 108, the torque on the fibers can be prevented from being transmitted to the spool I 103 by the two wire feeding pulleys; the rolling bearing I 107 is installed in the hole at the front end of the wire feeding platform 108, and the fibers can pass through the rolling bearing I 107. the wire feeding platform 108 is fixed on the bottom plate I 104 of the wire feeding mechanism. By adjusting the output torque of the torque motor I 101, the tension on the filaments during the working process can be controlled. The spool I 103 and the wire feeding platform 108 are both 3D printed parts.

Figure 3:
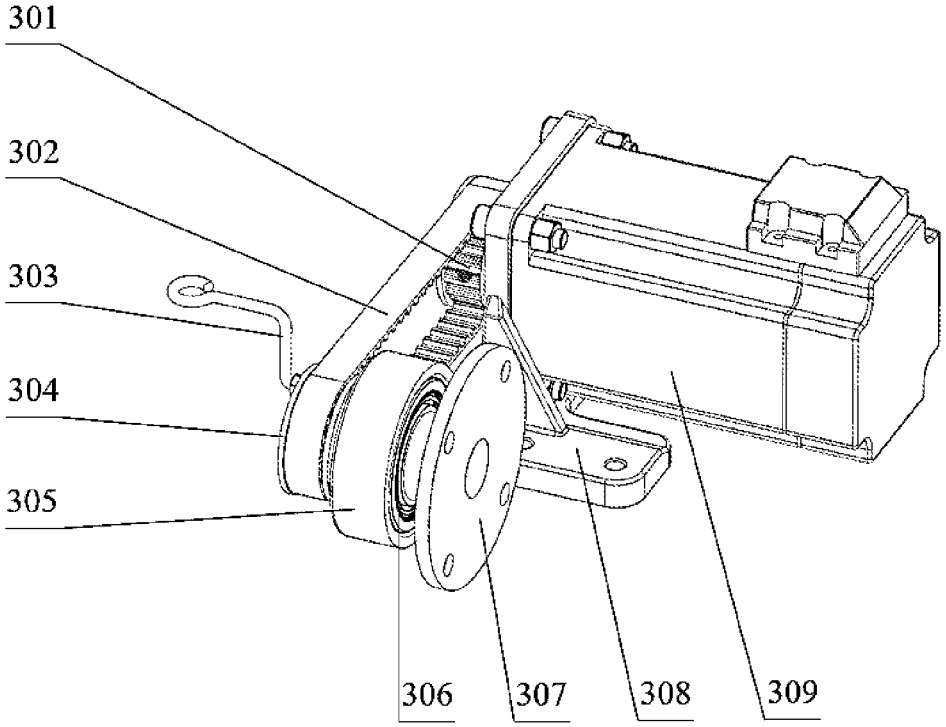
FIG. 3 is a schematic diagram of the twisting mechanism according to the present invention.

FIG. 3 is a schematic diagram of the twisting mechanism 300. As shown in FIG. 3, it includes synchronous belt wheel I 301, synchronous belt I 302, winding rod 303, synchronous belt wheel II 304, synchronous belt wheel support 305, rolling bearing II 306, twisting mechanism articulation seat 307, stepper motor mounting, support I308 and stepper motor I 309. The synchronous belt wheel I 301 is installed on the output shaft of the stepper motor I 309, and is limited by set screws to prevent relative sliding; the stepper motor I 309 is installed on the stepper motor mounting support I 308; one end of the winding rod 303 is tapped with an external thread to be threadedly connected to the synchronous belt wheel II 304; the synchronous belt wheel II 304 is installed on one end of the synchronous belt wheel support 305 and uses a set screw to prevent relative rotation; the inner side of the synchronous belt wheel support 305 is installed with the rolling bearing II 306 in an interference fit; the inner hole of the rolling bearing II 306 is an interference fit with the shaft of the twisting mechanism articulation seat 307; the synchronous belt 302 is installed on the two synchronous belt wheels. In this way, the stepper motor I 309 rotates the winding rod 303 by means of a belt drive, and the winding rod 303 rotates with the polymer fiber to perform the twisting operation. The winding rod 303, the synchronous belt wheel support 305 and the twisting mechanism articulation seat 307 are metal processing parts, and the others are purchased parts. Stepper motor I 309 adopts 57 high-speed closed-loop stepper motor to ensure accurate speed without losing steps.

Figure 4:
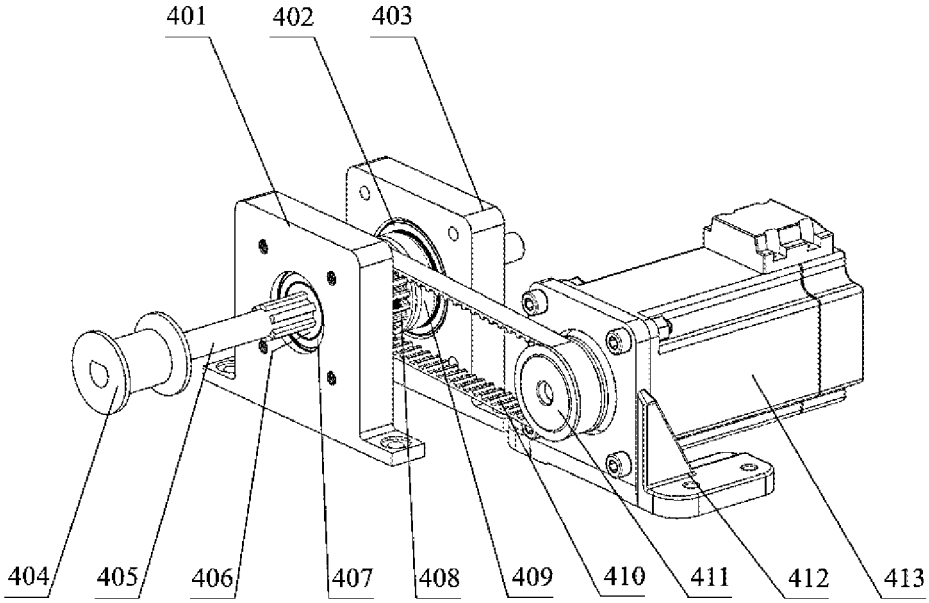
FIG. 4 is a schematic diagram of the winding mechanism according to the present invention.

FIG. 4 is a schematic diagram of the winding mechanism 400. As shown in FIG. 4, the winding mechanism includes a from support seat 401, a rolling hearing III 402, a rear support seat 403, a spool II 404, a spline shaft 405, a spline shaft sleeve 406, a rolling bearing IV 407, a synchronous belt wheel III 408, and a gear ring 409. a synchronous belt II 410, a synchronous belt wheel IV 411, a stepper motor mounting support II 412, a stepper motor II 413. The spool II 404 is installed at one end of the spline shaft 405; the spline shaft sleeve 406 is in an interference fit with the inner hole of the rolling bearing IV 407; the rolling hearing IV 407 is installed in the front support seat 401, And it is an interference fit with the inner hole of the front support seat 401; the spline shaft 405 is installed in the spline shaft sleeve 406, and can slide relative to the axial direction; the inner hole of the rear support seat 403 is also installed with rolling bearing, a spline shaft sleeve is installed in the rolling bearing, the spline shaft 405 passes through the spline shaft sleeve and is a clearance fit, and the spline shaft 405 can slide axially relative to the spline shaft sleeve (spline shaft sleeve is not shown in the figure); The spline shaft 405 is sleeved with two gear rings 409 and located between the front and rear support seats 401 and 403 (only one gear ring is shown in the figure); the inner hole of the synchronous belt wheel III 408 is also installed. There is a spline shaft sleeve and is installed on the spline shaft 405 (the spline shaft sleeve here is not shown in the figure), between the two gear rings 409; the synchronous belt wheel IV 411 is installed on the output shaft of stepper motor II 413, and is limited by set screws to prevent relative sliding; the stepper motor II 413 is installed on the stepper motor mounting support II 412; the synchronous belt II 410 is installed on the synchronous belt wheel III 408 and the synchronous belt wheel IV 411. The stepper motor II 413 drives the spline shaft 405 to rotate by means of belt drive, thereby making the spool II 404 rotate to complete the winding process. The front and rear support seats 401, 403, the spline shaft 405 and the spline shaft sleeve 406 are metal processing parts; the spool II 404 and the gear ring 409 are 3D printed parts, and the rest are purchased parts.

Figure 5:
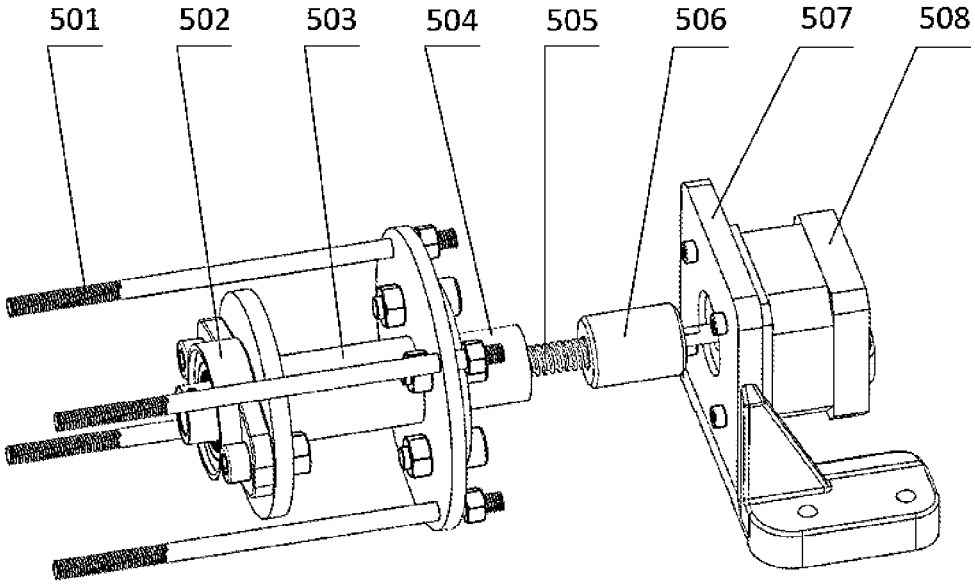
FIG. 5 is a schematic diagram of the translation mechanism according to the present invention.

FIG. 5 is a schematic diagram of the translation mechanism 500. As shown in FIG. 5, it includes a guide rod 501, a mounted bearing 502, a translation joint seat 503, a lead screw nut 504, a trapezoidal lead screw 505, a coupling 506, a stepper motor mounting support III 507, and a stepper motor III 508. The guide rod 501 is installed in the translation joint seat 503, and one end of the guide rod 501 is screwed into a nut to limit the position; the mounted bearing 502 is installed on the left end of the translation joint seat 503; the lead screw nut 504 is installed on the right end of the translation joint seat 503; the trapezoidal lead screw 505 is screwed into the lead screw nut 504; the stepper motor III 508 is installed on the stepper motor mounting support III 507; the coupling shaft 506 is used to connected the output shaft of the stepper motor III 508 and the trapezoidal lead screw 505. The stepper motor III 508 drives the translation joint seat 503 to slide on the guide rod 501. The guide rod 501 and the translation joint seat 503 are metal processing parts, and the others are purchased parts.

The following describes the working process of the continuous automatic twisting and winding device for polymer fiber artificial muscles according to the present invention:

First, the polymer fiber 200 is drawn from the spool I 103, so that the polymer fiber passes around the two wire feeding pulleys, namely the wire feeding pulley I 105 and the wire feeding pulley II 106. Then the polymer fiber 200 passes through the rolling bearing 107, winding rod 303 and is finally tied to the collector cylinder II 404. The torque motor 101 is powered on and adjusted to an appropriate torque T. The stepper motor I 309, the stepper motor II 413, and the stepper motor III 508 start to rotate at the same time. The stepper motor I 309 drives the synchronous belt wheel II 304 in the twisting mechanism 300 to rotate, and the winding rod 303 rotates with the synchronous belt wheel II 304 and the rotation speed is $\omega_1$. The winding rod 303 drives the polymer fiber 200 to rotate and starts to twist it; the stepper motor II 413 drives the spline shaft 405 in the winding, mechanism 400 to rotate at $\omega_2$, and the spool II 404 rotates together with the spline shaft 405. If $\omega_1 \neq \omega_2$, the spool II 404 starts to rewind the artificial muscle; the stepper motor III 508 reciprocates at $\omega_3$, and the trapezoidal lead screw 505 and the lead screw nut 504 cooperate to drive the translation joint seat 503 to reciprocate on the guide rod 501, the mounted bearing 502 drives the spline shaft 405 and the spool II 404 to reciprocate and translate so that the twisted polymer fibers 200 is evenly wounded on the spool II 404

The following relationship should be satisfied at this time:

$$\omega_3 = \frac{|\omega_1 - \omega_2| \cdot d}{S} \quad (1)$$

Where d is the diameter of polymer fiber, S is the lead of the trapezoidal lead screw.

An important parameter of twisting load F in the process of artificial muscle preparation satisfies the following relationship:

$$F = \frac{T}{r_1} \quad (2)$$

Where, $r_1$ is the radius of the spool I, and T is the output torque of the torque motor.

What is claimed is:

1. A continuous automatic twisting and winding device for polymer fiber artificial muscles, comprising a wire feeding mechanism, a twisting mechanism, a winding mechanism, a translation mechanism, and a base plate; wherein a polymer fiber is used by the twisting and winding device;

a center axis of a rolling bearing I in the wire feeding mechanism is horizontally aligned with a center axis of a spline shaft in the winding mechanism;

the polymer fiber comprises nylon fiber yarn or polyester fiber yarn;

the twisting mechanism, the winding mechanism, and the translation mechanism are mounted on the base plate;

a twisting mechanism articulation seat in the twisting mechanism is fixed to a front support seat in the winding mechanism;

a mounted bearing in the translation mechanism is connected with the spline shaft in the winding mechanism by an interference fit;

a guide rod in the translation mechanism is mounted on a rear support seat in the winding mechanism and is fixed with a nut;

wherein the wire feeding mechanism comprises a torque motor, a torque motor mounting support, a spool I, a bottom plate of the wire feeding mechanism, a wire feeding pulley I, a wire feeding pulley II, the rolling bearing I and a wire feeding platform; the torque motor is fixed on the bottom plate of the wire feeding mechanism through the torque motor mounting support; the spool I is installed on an output shaft of the torque motor; the wire feeding pulley I and the wire feeding pulley II are installed on the wire feeding platform, and the wire feeding pulley I and the wire feeding pulley II are configured to prevent a torque of the fiber from being transmitted to the spool I; the rolling bearing I is installed in a hole at a front end of the wire feeding platform, the fiber passing through the rolling bearing I can effectively reduce an abrasion of a fiber filament; the wire feeding platform is fixed on the bottom plate of the wire feeding mechanism, and a tension on the fiber filament during a working process can be controlled by adjusting an output torque of the torque motor;

wherein the twisting mechanism comprises a synchronous belt wheel I, a synchronous belt I, a winding rod, a synchronous belt wheel II, a synchronous belt wheel support, a rolling bearing II, the twisting mechanism articulation seat, a stepper motor mounting support I and a stepper motor I; the synchronous belt wheel I is installed on an output shaft of the stepper motor I, and is limited by set screws to prevent a relative sliding; the stepper motor I is installed on the stepper motor mounting support I; one end of the winding rod is tapped with an external thread to be threadedly connected to the synchronous belt wheel II; the synchronous belt wheel II is installed on one end of the synchronous belt wheel support and set screws are configured to prevent a relative rotation of the synchronous belt wheel II; an inner side of the synchronous belt wheel support is installed with the rolling bearing II in the interference fit; an inner hole of the rolling bearing II is the interference fit with a shaft of the twisting mechanism articulation seat; the twisting mechanism articulation seat is installed on the front support seat of the winding mechanism; the synchronous belt I is installed on the synchronous belt wheel I and on the synchronous belt wheel II; wherein the stepper motor I rotates the winding rod by means of a belt transmission, and the winding rod rotates the polymer fiber to complete a twisting.

2. A continuous automatic twisting and winding device for polymer fiber artificial muscles, comprising a wire feeding mechanism, a twisting mechanism, a winding mechanism, a translation mechanism, and a base plate; wherein a polymer fiber is used by the twisting and winding device;

a center axis of a rolling bearing I in the wire feeding mechanism is horizontally aligned with a center axis of a spline shaft in the winding mechanism;

the polymer fiber comprises nylon fiber yarn or polyester fiber yarn;

the twisting mechanism, the winding mechanism, and the translation mechanism are mounted on the base plate;

a twisting mechanism articulation seat in the twisting mechanism is fixed to a front support seat in the winding mechanism;

a mounted bearing in the translation mechanism is connected with the spline shaft in the winding mechanism by an interference fit;

a guide rod in the translation mechanism is mounted on a rear support seat in the winding mechanism and is fixed with a nut;

wherein the wire feeding mechanism comprises a torque motor, a torque motor mounting support, a spool I, a bottom plate of the wire feeding mechanism, a wire feeding pulley I, a wire feeding pulley II, the rolling bearing I and a wire feeding platform; the torque motor is fixed on the bottom plate of the wire feeding mechanism through the torque motor mounting support; the spool I is installed on an output shaft of the torque motor; the wire feeding pulley I and the wire feeding pulley II are installed on the wire feeding platform, and the wire feeding pulley I and the wire feeding pulley II are configured to prevent a torque of the fiber from being transmitted to the spool I; the rolling bearing I is installed in a hole at a front end of the wire feeding platform, the fiber passing through the rolling bearing I can effectively reduce an abrasion of a fiber filament; the wire feeding platform is fixed on the bottom plate of the wire feeding mechanism, and a tension on the fiber filament during a working process can be controlled by adjusting an output torque of the torque motor;

wherein the winding mechanism comprises the front support seat, a rolling bearing III, the rear support seat, a spool II, the spline shaft, a spline shaft sleeve, a rolling bearing IV, a synchronous belt wheel III, gear rings, a synchronous belt II, a synchronous belt wheel IV, a stepper motor mounting support II, a stepper motor II, wherein the spool II is installed on one end of the spline shaft; the spline shaft sleeve has the interference fit with an inner hole of the rolling bearing IV; the rolling bearing IV is installed in the front support seat and has the interference fit with an inner hole of the front support seat; the spline shaft is installed in the spline shaft sleeve, and can slide relative to an axial direction; an inner hole of the rear support seat is also installed with a rolling bearing, the rolling bearing of the rear support seat is installed with a spline shaft sleeve, and the spline shaft passes through the spline shaft sleeve of the rear support seat in a clearance fit, and the spline shaft can slide axially relative to the spline shaft sleeve of the rear support seat; the spline shaft is sleeved with two of the gear rings and is located between the front support seat and the rear support seat; an inner hole of the synchronous belt wheel III is also installed with a spline shaft sleeve and is installed on the spline shaft, which is located between the two of the gear rings; the synchronous belt wheel IV is installed on an output shaft of the stepper motor II, and is limited by set screws to prevent a relative sliding; the stepper motor II is installed on the stepper motor mounting support II; the synchronous belt II is installed on the synchronous belt wheel III and the synchronous belt wheel IV; the stepper motor II rotates the spline shaft by means of a belt transmission, so as to make the spool II rotate to complete a winding process.

3. The continuous automatic twisting and winding device for the polymer fiber artificial muscles according to claim 1, wherein the translation mechanism comprises the guide rod, the mounted bearing, a translation joint seat, a lead screw nut, a trapezoidal lead screw, a coupling shaft, a stepper motor III and a stepper motor mounting support III;

wherein one end of the guide rod is installed in the translation joint seat, and the other end of the guide rod is screwed into said nut fixed to the guide rod for a limiting; the mounted bearing is installed on a left end of the translation joint seat; the lead screw nut is installed on a right end of the translation joint seat; the trapezoidal lead screw is screwed into the lead screw nut; the stepper motor III is installed on the stepper motor mounting support III; the coupling shaft is connected with an output shaft of the stepper motor III and the trapezoidal lead screw; the stepper motor III drives the translation joint seat to slide on the guide rod.

4. A method for continuous automatic twisting and winding of polymer fiber artificial muscles using a device, the device comprising a wire feeding mechanism, a twisting mechanism, a winding mechanism, a translation mechanism, and a base plate; wherein a polymer fiber used by the twisting and winding device;

a center axis of a rolling bearing I in the wire feeding mechanism is horizontally aligned with a center axis of a spline shaft in the winding mechanism;

the polymer fiber comprises nylon fiber yarn or polyester fiber yarn;

the twisting mechanism, the winding mechanism, and the translation mechanism are mounted on the base plate;

a twisting mechanism articulation seat in the twisting mechanism is fixed to a front support seat in the winding mechanism;

a mounted bearing in the translation mechanism is connected with the spline shaft in the winding mechanism by an interference fit;

a guide rod in the translation mechanism is mounted on a rear support seat in the winding mechanism and is fixed with a nut;

wherein the wire feeding mechanism comprises a torque motor, a torque motor mounting support, a spool I, a bottom plate of the wire feeding mechanism, a wire feeding pulley I, a wire feeding pulley II, the rolling bearing I and a wire feeding platform; the torque motor is fixed on the bottom plate of the wire feeding mechanism through the torque motor mounting support; the spool I is installed on an output shaft of the torque motor; the wire feeding pulley I and the wire feeding pulley II are installed on the wire feeding platform, and the wire feeding pulley I and the wire feeding pulley II are configured to prevent a torque of the fiber from being transmitted to the spool I; the rolling bearing I is installed in a hole at a front end of the wire feeding platform, the fiber passing through the rolling bearing I can effectively reduce an abrasion of a fiber filament; the wire feeding platform is fixed on the bottom plate of the wire feeding mechanism, and a tension on the fiber filament during a working process can be controlled by adjusting an output torque of the torque motor; wherein the polymer fiber is a first polymer fiber that is one of a plurality of polymer fibers and wherein the method comprises:

first, the plurality of polymer fibers are drawn from the spool I, so that the plurality of polymer fibers pass around the two wire feeding pulleys, namely the wire feeding pulley I and the wire feeding pulley II; then the plurality of polymer fibers sequentially pass through the rolling bearing I, a winding rod and finally to be tied to a spool II, the torque motor is powered on and adjusted to an appropriate torque T; a stepper motor I, a stepper motor II, and a stepper motor III start to rotate at the same time, and the stepper motor I drives a synchronous belt wheel II in the twisting mechanism to rotate; the winding rod rotates with the synchronous belt wheel II and a rotation speed is $\omega_1$; the winding rod drives the first polymer fiber to rotate and starts to twist the first polymer fiber; the stepper motor II drives the spline shaft in the winding mechanism to rotate at $\omega_2$, and the spool II rotates with the spline shaft; if $\omega_1 \neq \omega_2$, the spool II starts to rewind the artificial muscles; the stepper motor III rotates in reciprocating at $\omega_3$, and a trapezoidal lead screw and a lead screw nut cooperate to drive a translation joint seat for a reciprocating movement on the guide rod, the mounted bearing drives the spline shaft and the spool II to reciprocate and translate so that twisted polymer fibers of the plurality of polymer fibers are evenly wound on the spool II, the following relationship should be satisfied at this time:

$$\omega_3 = \frac{|\omega_1 - \omega_2| \cdot d}{S} \tag{1}$$

wherein d is a diameter of the first polymer fiber, S is a lead of the trapezoidal lead screw, parameter of a twisting load F in a process of an artificial muscle preparation satisfies the following relationship:

$$F = \frac{T}{r_1} \tag{2}$$

wherein, $r_1$ is a radius of the spool I, and T is the output torque of the torque motor.

* * * * *